US005630965A

United States Patent [19]

Shaw et al.

[11] Patent Number: 5,630,965

[45] Date of Patent: May 20, 1997

[54] LOW FORCE LIMIT DEVICE

[75] Inventors: Scott R. Shaw, Nashville; Richard L. Morris, Franklin, both of Tenn.

[73] Assignee: U.S.A. Zama, Inc., Franklin, Tenn.

[21] Appl. No.: 663,601

[22] Filed: Jun. 14, 1996

Related U.S. Application Data

[63] Continuation of Ser. No. 459,483, Jun. 2, 1995, abandoned.

[51] Int. Cl.[6] ..... F02M 3/08

[52] U.S. Cl. ..... 261/71; 261/DIG. 38; 261/DIG. 84; 137/382

[58] Field of Search ..... 261/71, DIG. 38, 261/DIG. 84; 137/382

[56] References Cited

U.S. PATENT DOCUMENTS

| | | | |
|---|---|---|---|
| 3,618,906 | 11/1971 | Charron | 261/41.5 |
| 4,097,561 | 6/1978 | Seki et al. | 261/DIG. 38 |
| 4,120,918 | 10/1978 | Codling | 261/DIG. 38 |
| 4,271,095 | 6/1981 | Maeda | 261/41.5 |
| 4,283,353 | 8/1981 | Miller | 261/41.5 |
| 4,333,891 | 6/1982 | Miller | 261/41.5 |
| 5,055,238 | 10/1991 | Araki | 261/35 |
| 5,236,634 | 8/1993 | Hammett et al. | 261/71 |
| 5,252,261 | 10/1993 | Gerhardy | 261/71 |
| 5,322,645 | 6/1994 | Hammett et al. | 261/71 |

FOREIGN PATENT DOCUMENTS

| | | |
|---|---|---|
| 2352955 | 12/1977 | France . |
| 2401803 | 1/1974 | Germany . |
| 2548226 | 10/1975 | Germany . |
| 61-134555 | 8/1985 | Japan . |

*Primary Examiner*—Tim R. Miles
*Attorney, Agent, or Firm*—Lyon & Lyon LLP

[57] ABSTRACT

A carburetor fuel adjusting limit device that facilitates control of the quantity of fuel that flows from the fuel chamber to an air intake port of a carburetor by making it possible for the user to adjust a fuel adjustment valve within the limits defined by emission control regulations. The limit device has a cap that comprises an engagement area to engage a valve extension of the fuel adjustment valve and radially extending appendages to limit rotation. The construction of the engagement area, which includes axial and radial locks, enables the cap to be pressed onto the valve extension with a relatively low amount of force. The fuel adjustment valve includes a screw head attached to the valve extension and constructed to break away from the valve extension at a torque that exceeds about 8 kg-cm. A retainer is utilized to retain the cap in a disengaged position adjacent the valve extensions. Once the cap is pressed onto the valve extension the cap and the fuel adjustment valve rotate as a unit.

31 Claims, 7 Drawing Sheets

LOW FORCE LIMIT DEVICE

This is a continuation of application Ser. No. 08/459,483, filed on Jun. 2, 1995 and which designated the U.S., now abandoned.

FIELD OF THE INVENTION

This invention relates to carburetors designed to supply fuel to multi-purpose engines that power agricultural equipment, gardening equipment, and small vehicles and, more particularly, devices for the manual adjustment of fuel flow quantity for such carburetors.

BACKGROUND

Carburetors for multi-purpose engines supply a considerably lower quantity of fuel to the engine in comparison with carburetors that supply fuel to four-stroke engines, such as automobile engines. Significant changes in fuel mixture ratio result from inaccuracies in carburetor component placement and dimension, and from deficiencies in component quality. These factors, along with the difference in performance associated with different engines, make it necessary to be able to adjust carburetor fuel flow quantity separately for each individual engine.

Given this necessity, a manually adjustable fuel valve is included in the design of some carburetors. Such valves comprise a needle-shaped, tapered valve inserted in the fuel jet of the carburetor and mounted on the end of a threaded rod which screws into the carburetor body. An extension at an opposite end from the needle valve extends from the threaded rod and protrudes from the carburetor body. By twisting the extension, the needle valve can be moved back and forth within the carburetor body, thus changing the effective cross-sectional area of the jet. This adjusts the quantity of fuel flow through the jet. Both a main fuel jet and a low-speed fuel jet can be equipped with such valves, thus making it possible to adjust fuel flow quantity separately for each jet.

These valves are normally adjusted by either the manufacturers of the carburetors, or the manufacturers of the engines, vehicles or appliances on which the carburetors are used, to ensure that the engine receives the proper amount of fuel. In certain situations, i.e., when the engine performance is affected by operating in different locations or under different conditions, or simply when there is a temporary loss of engine power, the user of the vehicle or appliance may attempt to adjust these valves. As a result, an excessively rich or excessively lean fuel and air mixture may be created, often resulting in loss of engine power, engine smiling, or poorer exhaust quality, i.e. more unwanted emissions.

In an attempt to reduce emissions from multi-purpose engines, regulations have been put into effect in recent years. These regulations make it necessary to equip these engines with a limiting device that allows the user to make adjustments, after the manufacturer has adjusted the carburetor, that result in emissions that are substantially only within a range allowed by the regulations. These devices must also be constructed such that they are difficult to remove from the carburetors.

Devices to limit the adjustment of the fuel adjustment valve have been described in the art. U.S. Pat. No. 3,618,906 describes a cap that has been installed on the end of the adjustment valve. The cap is equipped with a radially protruding appendage that limits adjustment to within one revolution because the appendage is obstructed by a stopper protruding from the carburetor body. U.S. Pat. No. 5,236,634 describes valves for both the main fuel jet and the low-speed fuel jet as being placed parallel and adjacent to each other and having a cap with an appendage being obstructed by the other adjustment valve, or cap thereon, acting as a stopper.

However, both of these valve adjustment limitation devices protrude from the carburetor body. Their exposure makes it easier for the user to remove them with a bit of ingenuity. Thus, these devices do not prevent deliberate and resolute tampering by the user.

Other shortcomings with these designs exist during the manufacturing or assembly process. It is a difficult task to assemble the very small parts by hand. In some instances the appendages are not positioned correctly in relation to their stoppers. This results in some carburetors having a wider adjustable range in one direction, which could possibly produce an excessively rich or excessively lean mixture and make it substantially possible to operate outside the legal limit for emissions. Additionally, the relatively large force needed to press the cap onto the end of a valve, presents a risk of possible engine damage or improper adjustment of the valve. Further, in some cases, it may be possible to override the radial lock between the cap and the adjustment valve.

Therefore, it would be desirable to have a limiting device, for a carburetor having manually adjustable valves that are able to adjust the effective cross-sectional area of the main and low-speed fuel jets separately, that are capable of preventing and revealing deliberate and resolute tampering by the user, eliminating the difficulty in handling small parts, and preventing the emissions, when the engine is being used in a normal manner, from exceeding the legal limitations due to an inaccurate setting made by the manufacturer. In addition, it would be desirable to have a limiting device capable of being installed adjustment valves with a relatively small amount of force.

SUMMARY OF THE INVENTION

A primary objective of the present invention is to provide a fuel adjusting device, which comprises limiting caps that engage the extensions of the fuel adjustment valves and possess radially protruding appendages whose rotation is obstructed by stoppers, that prevents and reveals tampering by the user, that is easy to handle and can be installed with minimal force, and that allows the user to make adjustments only within the limits of the emission regulations.

In an exemplary embodiment of the present invention, the components are easier to handle, the installation of the components can be accomplished with a minimal amount of force, the possibility of deliberate tampering by the user is reduced because the caps are pressed into a retainer that is fixed onto the carburetor body, and if tampering does occur it is easily revealed due to the construction of the cap and adjustment valve. In addition, due to the construction of the appendage and stopper, and predetermination of the respective retaining positions of the caps within the retainer, the user is substantially only able to make adjustments to the valves that result in emissions within an allowable range.

In order to achieve such objectives, the limiter cap of the present invention has an insertion hole for a tool to pass through to adjust the valve. At the end of the insertion hole, there is an engagement area where the cap becomes attached to and retained on the valve. Once engaged, the cap and valve act as one unit, moving together when turned. At the base end of the cap, there is a primary and a secondary appendage. The appendages protrude radially from positions predetermined by necessary phasing, and that separately limit turning in both the direction that creates a richer mixture and the direction that creates a leaner mixture.

To reduce the force necessary to press the cap on the adjustment valve, an axial locking latch which folds out of the way during installation is providing in the engagement area. Once the cap is in place the latch closes into a cap lock groove on the adjustment valve to provide an axial lock between the adjustment valve and the cap. The force necessary to remove the cap from the adjustment valve is sufficient to shear the latch and, thus, reveal that the cap was tampered with.

A radial lock between the cap and the adjustment valve is provided by a course knurl on the adjustment valve which engages a radial locking area in the insertion hole engagement area of the cap. A break away screw head is provided on the adjustment valve to prevent a user from attempting to override the radial lock between the cap and adjustment valve.

A retainer that is attached to the carburetor body provides room for the cap to remain in a position in a retention hole disengaged from the extension of the adjustment valve. It is preferable that it not be possible for the cap to turn while in this disengaged position, but that the cap be able to move forward, under a relatively low amount of force, to engage the extension of the adjustment valve.

In cases where only one cap is engaged onto the main fuel jet valve, the extension of the low-speed fuel jet valve, or a protrusion included in the structure of the retainer, becomes the stopper. The construction of the device is such that the stopper is located between the two appendages of the cap.

However, where a cap is to be installed on both valves, each cap becomes a stopper for the other. The construction of the device being such that each cap is located between the two appendages of the opposite cap.

Furthermore, it is preferable to prevent the cap in the disengaged position from slipping out of the retainer's retention hole by installing a protrusion on the cap that prevents this, and by creating a cylindrical cut-out, having a smaller cross-section than that of the cap, to be used as the retention hole.

In addition, the cap preferably cannot be turned when in the disengaged position, but it is preferable that it be able to turn when inserted forward into the retention hole into the engaged position. When the cap is inserted through the retention hole, it is in a preferred position, such that the secondary appendage almost touches its stopper enabling the user to adjust substantially only in the leaner mixture direction.

Further, when two caps are employed, it is preferable that both the caps are of the same dimensions, are positioned such that they are at a 180 degree angle to each other in the disengaged position, and cannot be turned when inserted into the retention hole to be retained in the disengaged position.

In operation, the manufacturer adjusts the effective cross-sectional area of the fuel jet to a predetermined fuel flow quantity by adjusting the valve. This is accomplished by inserting a tool through the insertion hole of the cap while it is in the disengaged position in the retention hole. Next, the cap is pressed forward, engaging the cap with the end of the adjustment valve. From this point on, the cap and valve become securely attached to each other and move in unison, thus allowing the user to make adjustments substantially only within the range defined by the opening between the appendages. The cap is also held within the retainer hole of the retainer and is not completely exposed, thus making it more difficult to be removed.

DETAILED DESCRIPTION OF THE PREFERRED EMBODIMENT

Figure 1:
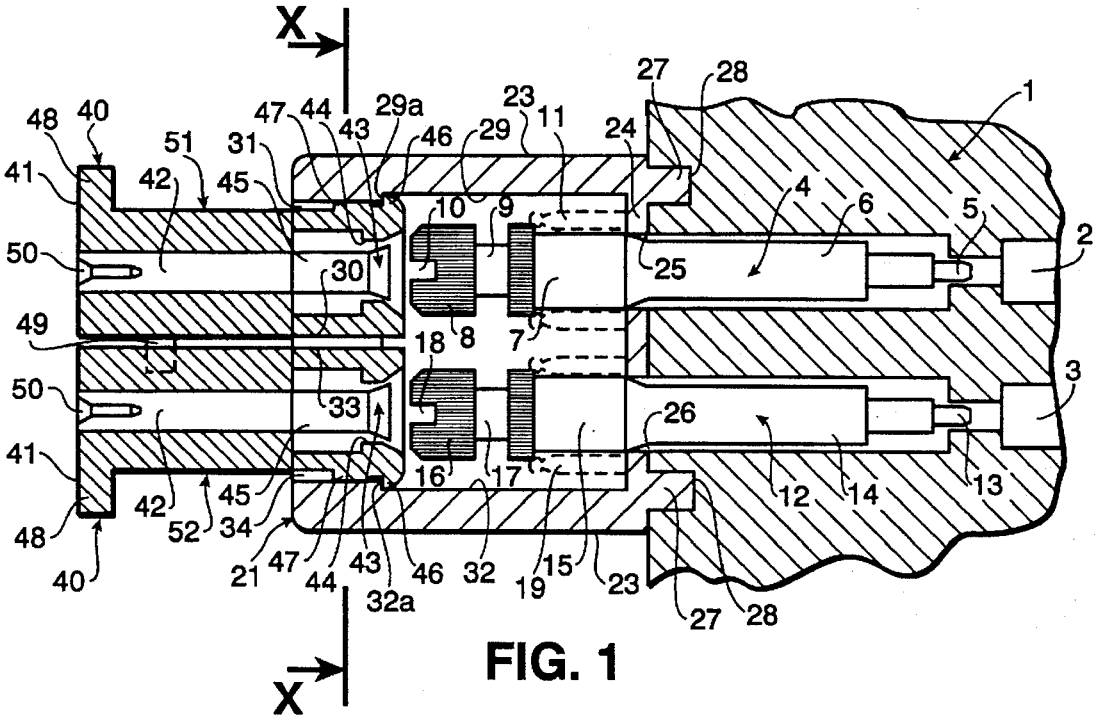
FIG. 1 is a cross-sectional view of a first embodiment of the present invention in a disengaged position.

Referring now in detail to the drawings, there is illustrated a novel carburetor fuel adjusting device for a general purpose engine carburetor according to the present invention. Turning to FIGS. 1 to 5 to describe a first embodiment of present invention, fuel flows from a diaphragm or float chamber, not shown, through an intake passage, also not shown, that leads to a main fuel jet 2 and a low-speed fuel jet 3 in a carburetor body 1, and on through to a main nozzle, an idling port, and a slow port, also not shown. The effective areas of the main and low-speed fuel jets 2 and 3 are adjusted separately by manual adjustment valves 4 and 12, which are placed parallel and adjacent to each other.

The adjustment valves 4 and 12 comprise tapered needle valves 5 and 13 inserted into the fuel jets 2 and 3, threaded rods 6 and 14 screwed into the carburetor body 1, valve extensions 7 and 15 protruding from the carburetor body 1. The valve extensions 7 and 15 are knurled at their ends in a straight pattern parallel to their longitudinal axis to create knurled heads 8 and 16 adjacent cap lock grooves 9 and 17 in the valve extensions 7 and 15. In addition, tool slots 10 and 18, which are used for making valve adjustments, are located in the end of the knurled heads 8 and 16.

A retainer 21, preferably made of hard plastic, is substantially box-shaped and comprises a bottom wall 22, side walls 23, and a contact wall 24. The contact wall 24 possesses two assembly protrusions 27 that fit hermetically into two assembly holes 28 in the carburetor body 1. Loosening prevention springs 11 and 19, which are inserted between valve extensions 7 and 15 and the contact wall 24, continually push the contact wall 24 onto the carburetor 1, fixing the retainer 21 onto the carburetor 1.

Adjacent the contact wall 24 of the retainer 21 and the end of the carburetor body 1 are two cylindrical cut-outs 29 and 32 within the retainer 21. The valve extensions 7 and 15 of the adjustment valves 4 and 12 extend through extension holes 25 and 26 in the contact wall 24 into the cutouts 29 and 32 of the retainer 21. Retention holes 30 and 33 are located within the retainer 21 open and adjacent to the cutouts 29 and 32 and opposite the contact wall 24. The retention holes 30 and 33 are connected at their sides by a passage 35*a*, that is located at the base of a split groove 35. The split groove 35 is open on the side of the retainer 21 opposite the bottom wall 22. The retention holes 30 and 33 are totally round, but are slightly smaller in diameter near the cylindrical cut-outs 29 and 32. Also, grooves 31 and 34 are cut along the length of the retention holes 30 and 33, respectively, at positions located 180 degrees with respect to each other.

A cap 40 for each adjustment valve 4 and 12 preferably is made of hard plastic. A tool used for the adjustment of the adjustment valves 4 and 12, usually a screwdriver, can be inserted into an insertion hole 42 in the cap 40. The insertion hole 42 is a cylinder with an engagement area 43 located at the end of the insertion hole 42 opposite a base end 41 of the cap 40. The engagement area 43 comprises grips 44 and two protruding areas 45. The engagement grips 44 and the protruding area 45 are reciprocally located at 90 degree angles to each other. The engagement grips 44 fit into the cap lock grooves 9 and 17 of the extensions 7 and 15 of the adjustment valves 4 and 12, while the knurled heads 8 and 16 of the extensions 7 and 15 are enveloped by the protruding areas 45. The protruding areas 45 are of a slightly smaller diameter than the knurled heads 8 and 16 of the valve extensions 7 and 15.

A detachment prevention lip 46 is formed on the outer surface of the rim of the end opposite a base end 41 of the cap 40. The lip 46 contacts inner surfaces 29*a* and 32*a* which are adjacent the split groove 35 and formed by the cylindrical cut-outs 29 and 32. A key 47 is formed longitudinally along the outer surface of the end of the cap 40 and fits into grooves 31 and 34 in positions located 180 degrees in relation to each other.

In addition, installed on the outer surface of the base end 41 of the cap 40 are two wing-shaped appendages 48 and 49 that are out of phase with each other and staggered in relation to each other longitudinally along the axis of the cap 40. For example, a primary appendage 48 is located nearest the base end 41 of the cap 40 and sweeps an angle from 0° to 90°, approximately, while a secondary appendage 49 is spaced away from the primary appendage 48 longitudinally along the axis of the cap 40 and sweeps an angle from 90° to 180°, approximately. The primary appendage 48 limits the turning of the valve in the lean direction, and the secondary appendage 49 limits turning in the rich direction.

When one of the caps 40 is pressed into each of the retention holes 30 and 33, the detachment prevention lips 46 are located in a position in contact with the inner surfaces 29*a* and 32*a* of cylindrical cut-outs 29 and 32 preventing the caps 40 from slipping out of the retainer 21 when in the disengaged position (see FIG. 1). In this position, the caps 40 are squeezed and pressed upon since the diameter of the retention holes 30 and 33 is smaller in the area nearest the inner surfaces 29*a* and 32*a*. In addition, the caps 40 are retained and maintained in a state in which they cannot be turned because of the mutual action of the grooves 31 and 34 and keys 47.

By fixing the retainer 21 on the carburetor body 1 with the caps 40 retained therein in a disengaged position, the caps 40 are easy to handle, and it is not easy to forget to install the caps 40. Further, by configuring the retainer 21 to maintain the caps 40 at predetermined angles in relation to each other in the disengaged position, once the caps 40 are installed, it is substantially only possible for the user to adjust the adjustment valves 4 and 12 such that the emissions are within a range allowed by the regulation limitations.

While the caps 40 are in the disengaged position within the retainer 21, the manufacturer inserts a tool in the insertion hole 42 to engage the tool slots 10 and 18 in the end of knurled heads 8 and 16, and adjust, separately, the effective cross-sectional area of the two fuel jets 2 and 3 by adjusting adjustment valves 4 and 12. The adjustment to the valves 4 and 12 is made freely without any interference from the caps 40. The carburetor which has been adjusted by its manufacturer, is then installed on an engine where the engine manufacturer can make further wide-range adjustments while measuring the CO concentration of the engine's emissions.

When the final adjustment has been completed, the caps 40 are installed by pressing hard on the base end 41 of the caps 40 causing the caps 40 to slide forward guided by the keys 47 which are in the grooves 31 and 34 of the retainer 21. In the engagement area 43 of the insertion hole 42 of the caps 40, the engagement grips 44 fit into the cap lock grooves 9 and 17, and, at the same time, protruding area 45 will envelop the knurled heads 8 and 16, thus engaging the valve extensions 7 and 15 such that the caps 40 can neither move longitudinally nor rotationally relative to the valve (see FIG. 5). At this point, the key 47 leaves the grooves 31 and 34, and the cap 40 becomes engaged and integrated with valves 4 and 12 so as to turn in unison with the valves 4 and 12.

The user, therefore, receives the carburetor with caps 40 integrated and turning in unison with the adjustment valves 4 and 12, that is to say, in a final stage of assembly. The user can insert tools through insertion holes 42 to engage the tool slots 10 and 18 in the end of knurled heads 8 and 6, or use a tool to engage engagement slots 50 in the base end 41 of the caps 40 to make adjustments to the adjustment valves 4 and 12. These adjustments change the effective cross-sectional area of the fuel jets 2 and 3 while maintaining engine emissions within the regulation limitations.

Figure 2:
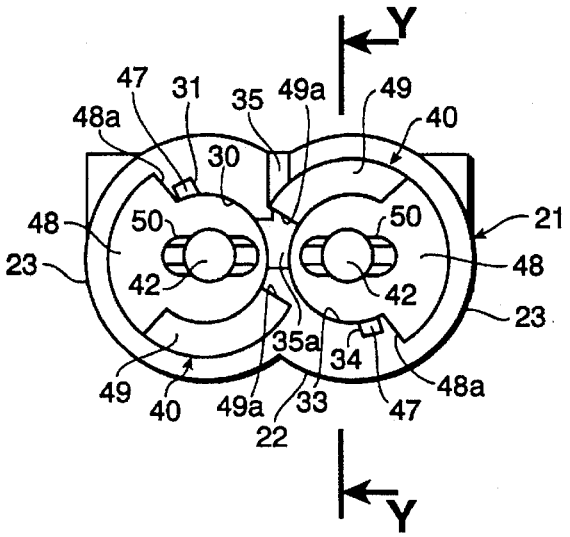
FIG. 2 is an end view viewed from the left side in FIG. 1 and rotated 90°.
Figure 3:
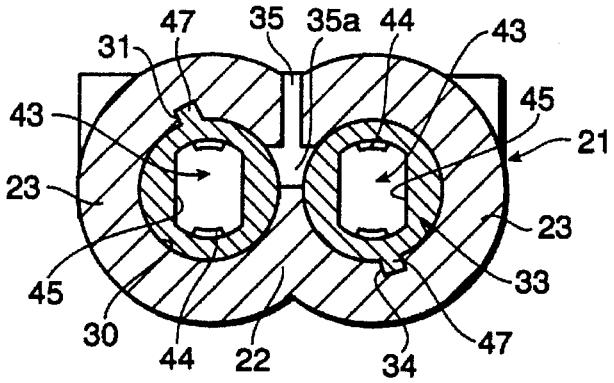
FIG. 3 is a cross-sectional view along a line X—X in FIG. 1 and rotated
Figure 4:
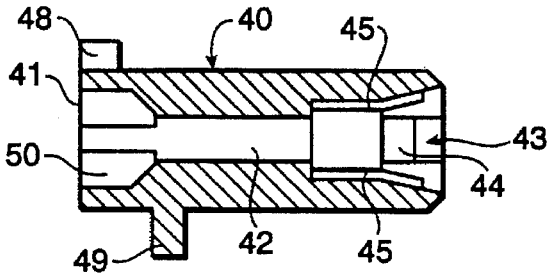
FIG. 4 is a cross-sectional view of a cap cut along a line Y—Y in FIG. 2.
Figure 5:
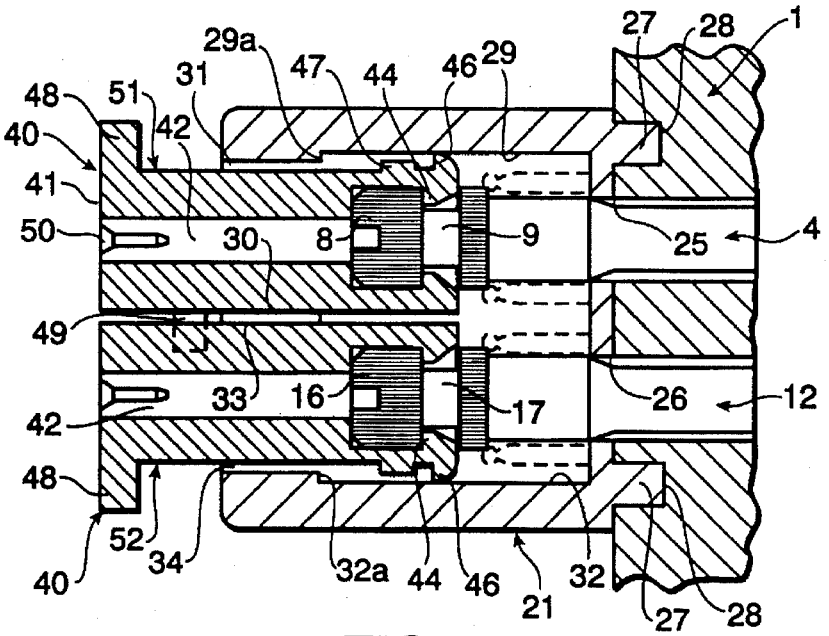
FIG. 5 is a cross-sectional view of the embodiment shown in FIG. 1 in an engaged position.

As shown in FIG. 2, the caps 40 are inserted into the retention holes 30 and 33 in such a position that the edge 49*a* of the secondary appendage 49, which limits turning in the rich mixture direction for each of the two caps 40, is almost in contact with the outer surface of the other cap 40. As a result, when the caps 40 are pressed forward and engaged with extensions 7 and 15, it becomes extremely difficult, if not impossible, to make adjustments in the direction that increases the effective cross-sectional area of the fuel jets 2 and 3, the "rich" direction. To do so, the user must overcome the engagement of the protruding area 45 of the caps 40 and the knurled heads 8 and 12 on the valve extensions 7 and 15.

On the other hand, it is possible to turn in the direction that decreases the effective cross-sectional area of fuel jets 2 and 3, the "lean" direction, to a point where the edge 48a of the primary appendage 48 comes in contact with the other cap 40. Therefore, by setting the turning angle range for the appendage 48 appropriately, and having the partner caps 40 acting as stoppers 51 and 52 for each other, the adjustments in the lean mixture direction, which does not increase the concentration of CO in the engine's emissions, can be made within the range of emission regulations.

It may also be desirable to adjust the range of emissions in either the lean or the rich mixture direction. The range of emission can be adjusted by increasing or decreasing the angle between the edges 48a and 49a of appendages 48 and 49.

Since the tips of the caps 40 are surrounded in three directions by the bottom wall 22 and side walls 23 of the retainer 21, and the middle part is retained within the retention holes 30 and 33, the caps 40 are not easily detached without destroying the retainer 21. Thus, the embodiment of the present invention tends to prevent a user's deliberate and resolute tampering.

Figure 6:
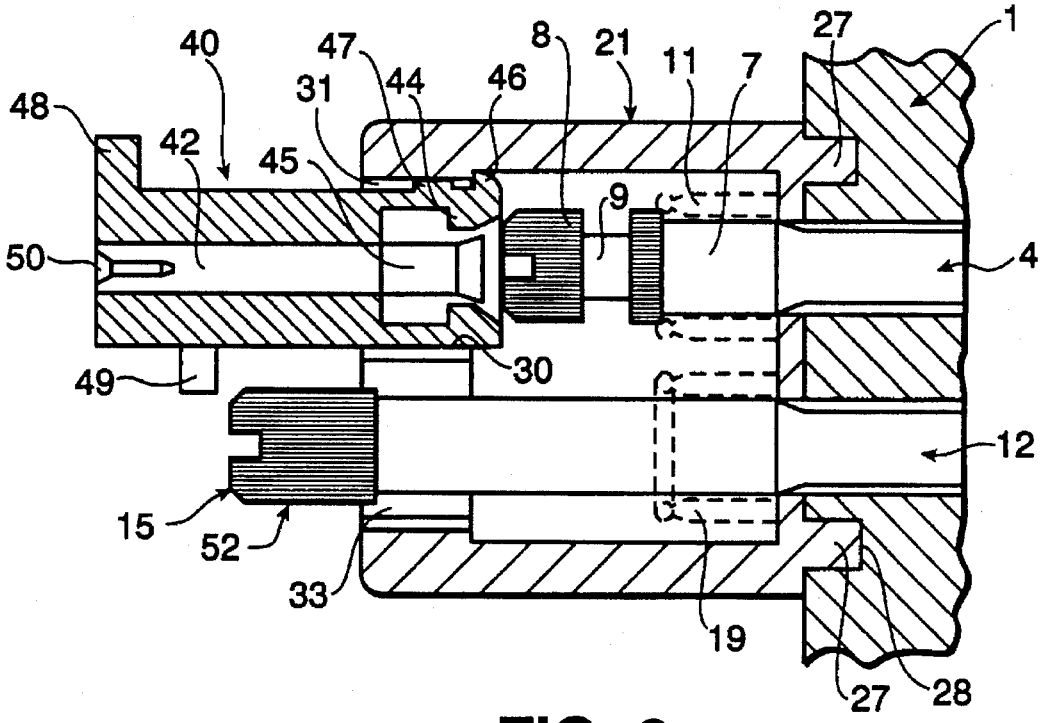
FIG. 6 is a cross-sectional view of a second embodiment of the present invention.

In the embodiment described above, the user is able to limitedly adjust both of the adjustment valves 4 and 12. Turning to FIG. 6, a second embodiment is shown in which the user can freely adjust the adjustment valve 12 of the low-speed fuel jet 3. The extension 15, of the adjustment valve 12, protrudes from the location of the retention hole 33 of the retainer 21 in the previous embodiment, while on the adjustment valve 4 of the main fuel jet 2 side of the retainer 21, the cap 40, described above, is arranged and inserted into the retention hole 30. As above, the angle between the two appendages 48 and 49 of the cap 40 determines the limits of the effective cross-sectional area of the main fuel jet 2. The adjustment valve 4 is rotated within the range of the fixed angle between the appendages 48 and 49 and is limited by using the extension 15, arranged between the appendages 48 and 49, as a stopper 52.

Figure 7:
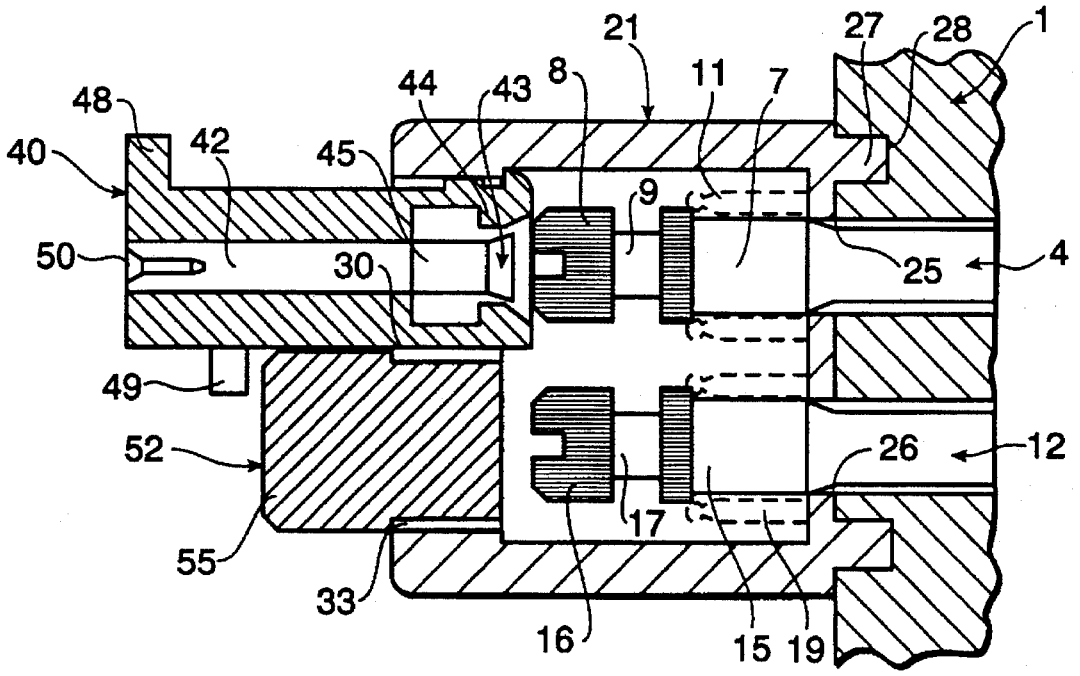
FIG. 7 is a cross-sectional view of a third embodiment of the present invention.
Figure 8:
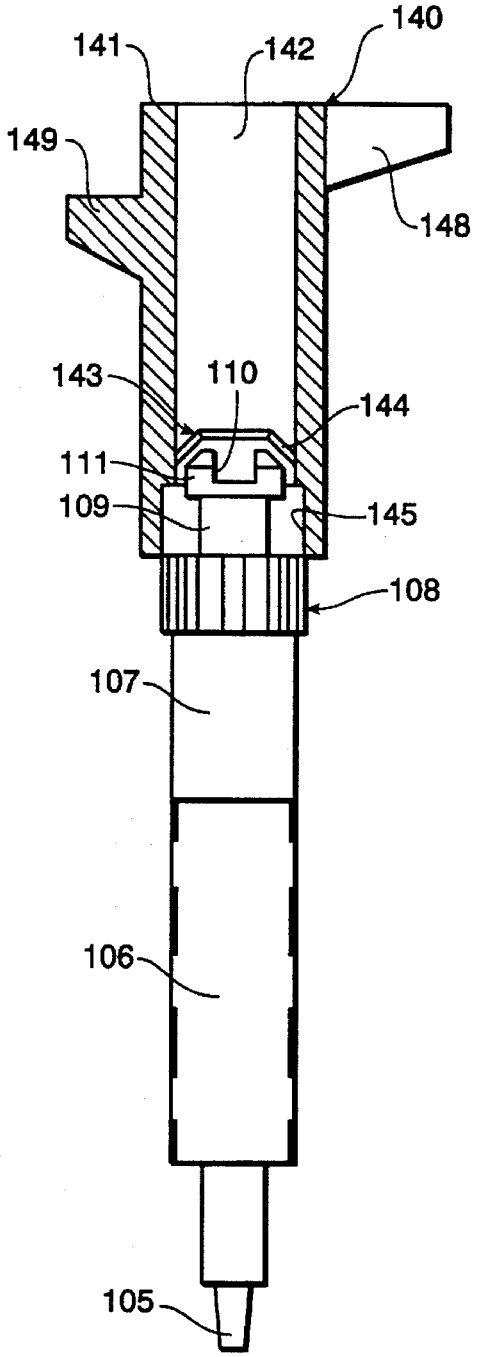
FIG. 8 is a fourth embodiment of the present invention showing a crosssectional view of a cap and a plan view of an adjustment valve in a disengaged position.

FIG. 7 shows a third embodiment wherein the user is not allowed to adjust the low-speed adjustment valve 12. A blank cap which comprises a protrusion 55 is attached to adjustment valve 12 in retention hole 33 of the retainer 21, making it substantially impossible to adjust the adjustment valve 12. The cap 40 of the previous two embodiments is inserted in retention hole 30 and attached on the main fuel jet 2 adjustment valve 4. The two appendages 48 and 49 of the cap 40 use the adjacent protrusion 55 as a stopper 52, and allow adjustment of the effective cross-sectional area of the main jet 2 by adjusting the adjustment valve 4 within a predetermined range defined by the angle between the appendages 48 and 49.

The embodiments illustrated and described in FIGS. 6 and 7 utilize the retainer 21 and the caps 40 of the embodiment illustrated and described in FIGS. 1 to 5 without substantial modification. Other variations of the embodiment of the present invention can be utilized on different types of carburetors, offering advantages in production and cost control.

Further, it is possible to attach the retainer 21 of the present invention to the carburetor body 1 with threads or by using adhesives. Such variations include enclosing adjustment valves 4 and 12 from all sides, using perfect cylinders for the retention holes 30 and 33, making the two appendages 48 and 49 into one integrated part, configuring the cap 40 and retainer 21 so that the cap 40 freely turns within the retainer 21 while in the disengaged position for adjustment during the manufacturing phase. Other variations are shown in FIGS. 8–16.

Turning to FIGS. 8–12, a fourth embodiment of the present invention is shown to comprise a cap 140 and an adjustment valve 104. The adjustment valve 104 is of needle valve construction comprising a tapered needle 105 extending from a threaded rod 106. As in the previous embodiments, the tapered needle 105 is inserted into the fuel jet 2,3 as the threaded rod 106 is screwed into the carburetor body 1. A valve extension 107 extends from the threaded rod 106 out of the carburetor body 1. A screw head 111 having a tool slot 110 is formed on the end of the extension 107. A cap lock groove 109 interposes the screw head 111 and a knurled head 108. Preferably, the knurled head 108 comprises a course knurl of eight spline knurls 108a extending longitudinally on the knurled head 108.

The cap 140 is configured similar to the cap 40 shown in FIGS. 1–7 such that it can be utilized with the retainer 21 also shown in FIGS. 1–7. The cap 140 comprises two wing-shaped appendages 148 and 149 attached to the outer surface of the cap 140 near its base end 141. The appendages 148 and 149 are out of phase with each other and staggered in relation to each other longitudinally along the axis of the cap 140. As in the previous embodiments, a primary appendage 148 is located nearest the base end 141 of the cap 140 and sweeps an angle from 0° to 90°, approximately, while a secondary appendage 149 is spaced away from the primary appendage 148 longitudinally along the axis of the cap 140 and sweeps an angle from 90° to 180°, approximately. The primary appendage 148 limits the turning of the valve in the lean direction, while the secondary appendage 149 limits turning in the rich direction.

The cap 140 can be received in either of the retention holes 30,33 of the retainer 21. A key 147 is longitudinally attached to the surface of the cap 140 and is configured to mate with the groove 31,34 in the retention hole 30,33 to prevent rotation of the cap 140 when in a disengaged position.

The cap 140 also has a cylindrical insertion hole 142 wherethrough a tool can pass to engage the tool slot 110 of the screw head 111 to adjust the adjustment valve 104. An engagement area 143 is located within the insertion hole 142 at an end opposite the base end 141 of the cap 140. The engagement area 143 comprises an axial locking latch 144 and a radial locking area 145.

The axial locking latch 144 is preferably constructed of a thin plastic and may include two to four slits 146 cut therein. The latch 144 angularly extends inwardly towards the base end 141 of the cap 140. This latch 144 configuration allows the latch 144 to fold out of the way during installation of the cap 140 thereby enabling the cap 140 to be pressed onto the adjustment valve 104 with minimal force, i.e., a maximum force of approximately thirty pounds. A result of the low force installation is a reduced likelihood of damage occurring to the engine or further adjustment occurring to the adjustment valve 104.

The radial locking area 145 comprises a smooth bore with a diameter that is larger than the diameter of the screw head 111 but smaller than the diameter of the knurled head 108 of the valve extension 107. This configuration enhances the cap's 140 capability of low force installation since the screw head 111 does not come in contact with the radial locking area 145 of the cap 140. The course knurls 108a of the knurled head 108 allow the plastic of the radial locking area 145 room to displace and create a large rib of plastic between the knurls 108a which better resists torque.

An alternative construction of the radial locking area 145 of the cap 140 includes lock grooves 145a cut into the bore of the radial locking area 145. Such a configuration tends to reduce the amount of plastic cut from the radial locking area 145 by the course knurls 108*a* on the knurled head 108 and, thus, reduces the amount of force necessary to press the cap 140 on the adjustment valve 104 while ensuring that sufficient plastic from the radial locking area 145 displaces between the knurls 148a on the knurled head 108 to provide a rib which better resists torque.

Figure 9:
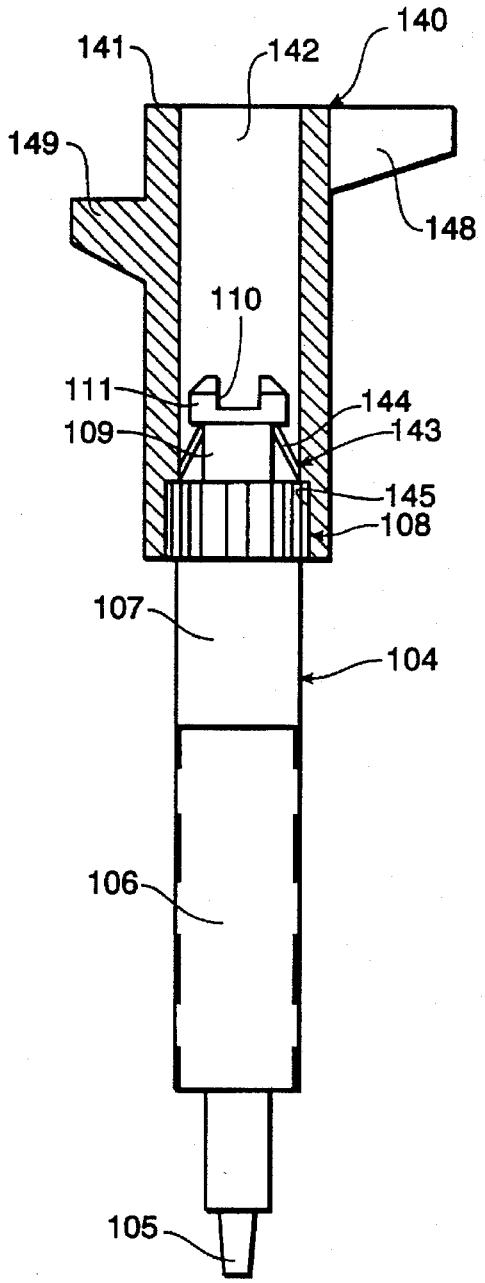
FIG. 9 is the embodiment in FIG. 8 shown in an engaged position.
Figure 10:
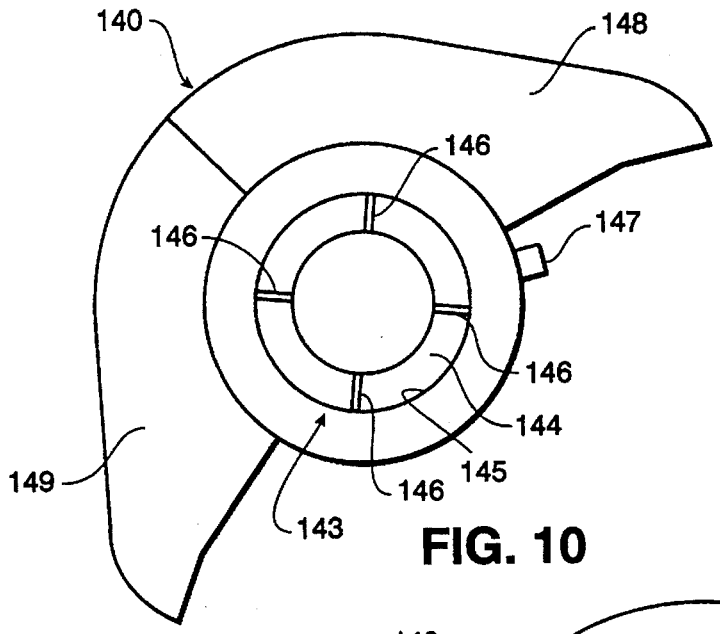
FIG. 10 is an end view viewed from the bottom of the cap in FIG. 8.
Figure 11:
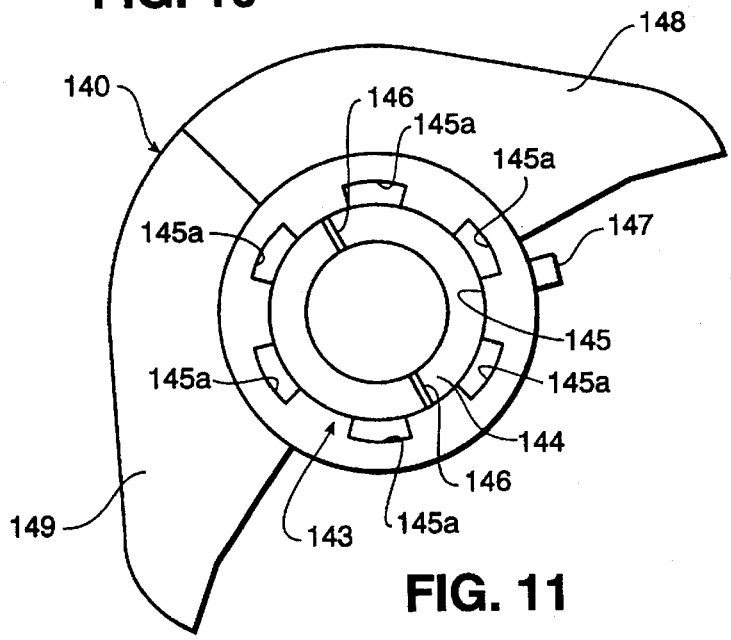
FIG. 11 is an end view viewed from the bottom of the cap in FIG. 8 and showing an alternate cap bore.
Figure 12:
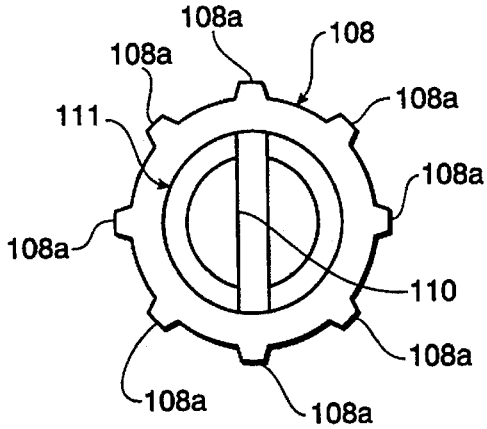
FIG. 12 is an end view viewed from the top of the adjustment valve in FIG. 8.
Figure 13:
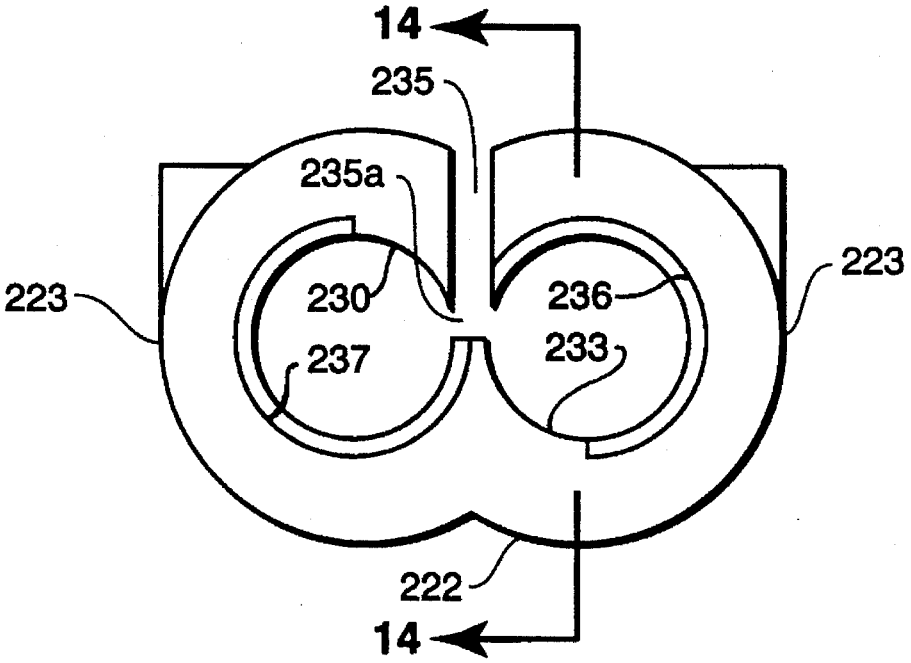
FIG. 13 is an end view of a retainer of a fifth embodiment of the present invention.
Figure 14:
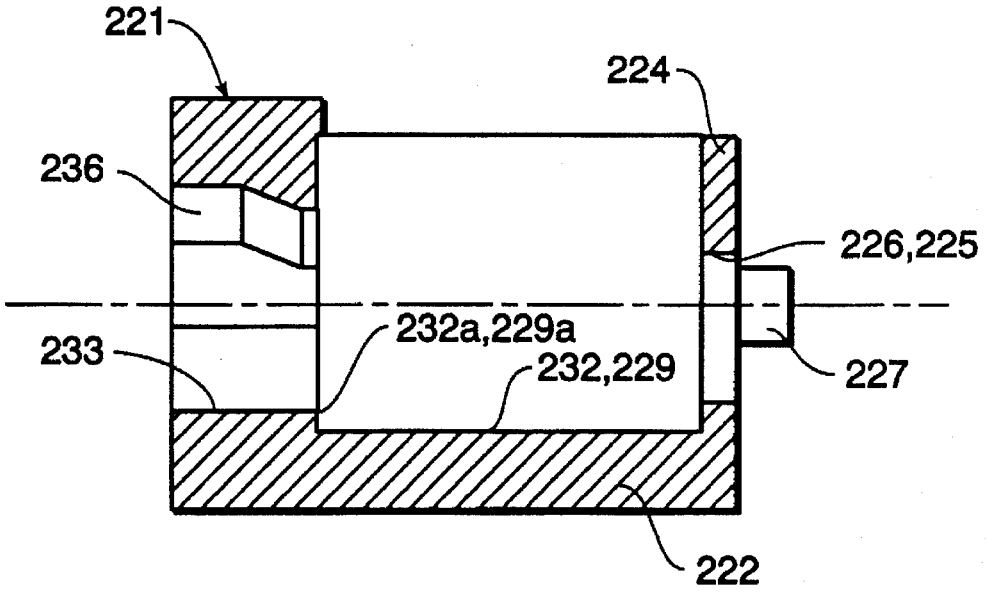
FIG. 14 is a cross-sectional view taken along a line 14—14 in FIG. 13.
Figure 15:
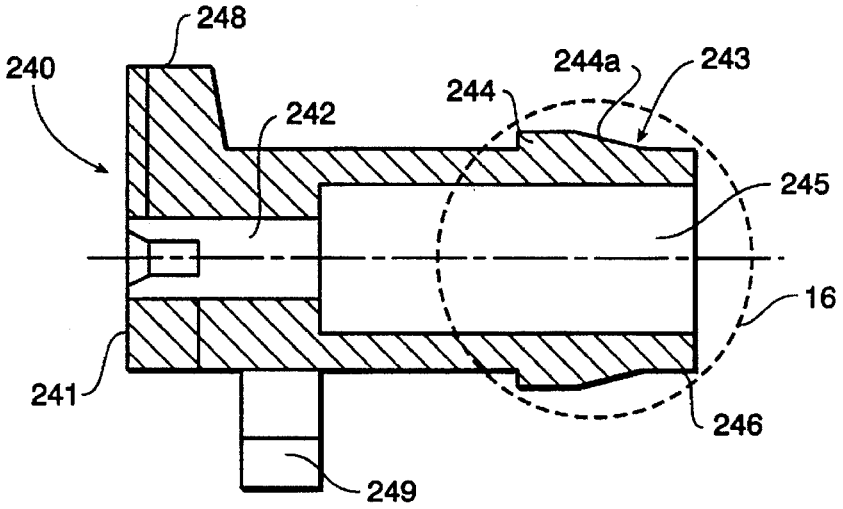
FIG. 15 is a cross-sectional view of a cap of the fifth embodiment of the present invention.
Figure 16:
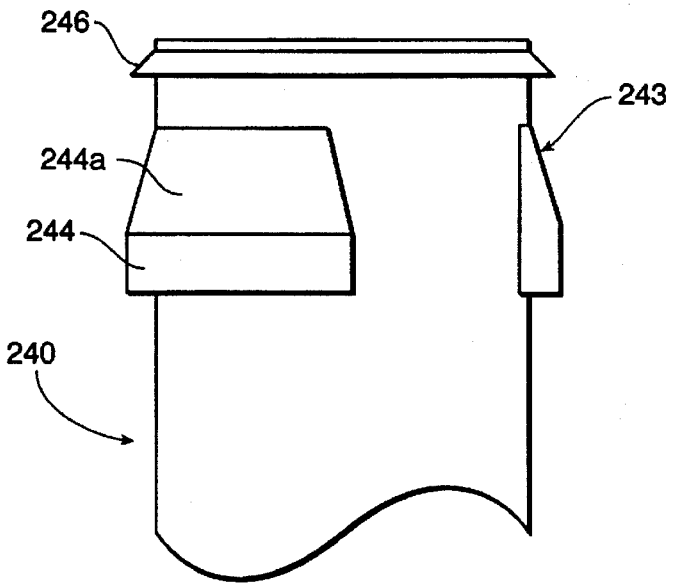
FIG. 16 is a detail view taken within a line 16 in FIG. 15.
Figure 17:
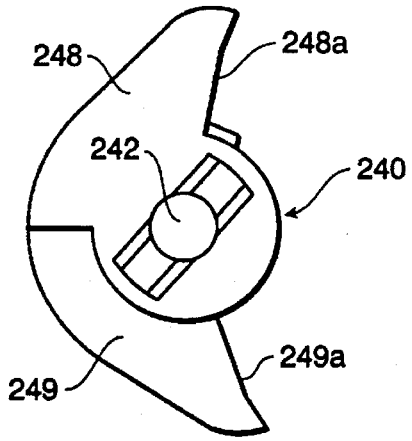
FIG. 17 is an end view taken from the left side of the cap in FIG. 15.

When the cap 140 is pressed into the locked or engaged position on the adjustment valve 104, as shown in FIG. 9, the latch 144 on the cap 140 folds out of the way as the cap 140 passes over the screw head 111 and then closes into the cap lock groove 109 on the adjustment valve 104. To then remove the cap 140 from the adjustment valve 104, the latch 144 would have to be compressed backwards, thus causing the latch 144 to buckle and bunch up inside the cap lock groove 109 of the adjustment valve 104. If enough force is used the latch 144 will shear off. The force needed to shear off the latch 144 will also permanently damage the cap 140 indicating it has been tampered with.

Since the base end 141 of the cap 140 does not have a tool slot to adjust the adjustment valve 104 and is open to the insertion hole 142 in the cap 140, adjustment of the adjustment valve 104, when the cap 140 is either engaged or disengaged, is done by inserting a tool in the tool slot 110 on the screw head 111 of the adjustment valve 104. To prevent a user from overriding the radial lock between the adjustment valve 104 and the cap 140, the screw head 111 is designed to break away at a maximum level of torque, i.e., if more than approximately 8 Kg cm torque is applied. This feature also tends to prevent the appendages 148, 149 on the cap 140 from being driven beyond their intended stop positions.

Turning to FIGS. 13–16, a fifth embodiment of the present invention is shown to comprise a cap 240 and a retainer 221. The retainer 221 is configured similarly to the retainer 21 shown in FIGS. 1–7, i.e., substantially box-shaped and comprising a bottom wall 222, side walls 223, a contact wall 224 possessing assembly protrusions 227 and extension holes 225 and 226, cylindrical cut-outs 229 and 232 adjacent the contact wall 224, and retention holes 230 and 233 located adjacent to the cutouts 229 and 232 and opposite the contact wall 224. The retention holes 230 and 233 are connected at their sides by a passage 235a that is located at the base of a split groove 235.

The cap 240 is configured similar to the caps 40 and 140, shown in FIGS. 1–12 such that it is utilized with the retainer 221 and adjustment valve 104 shown in FIGS. 8–12. The cap 240 comprises two wing-shaped appendages 248 and 249 attached to the outer surface of the cap 240 near its base end 241. The appendages 248 and 249 are out of phase with each other and staggered in relation to each other longitudinally along the axis of the cap 240. As in the previous embodiments, a primary appendage 248 is located nearest the base end 241 of the cap 240 and sweeps an angle from 0° to 90°, approximately, while a secondary appendage 249 is spaced away from the primary appendage 248 longitudinally along the axis of the cap 240 and sweeps an angle from 90° to 180°, approximately. The primary appendage 248 limits the turning of the valve in the lean direction, and the secondary appendage 249 limits turning in the rich direction. In addition, the tips of contact edges 248*a* and 249*a* of the primary and secondary appendages 248 and 249, respectively, are configured such that as the edges 248*a* and 249*a* come in rotational contact with the other cap 240 the tips tend to pull the caps 240 together.

The cap 240 has a cylindrical insertion hole 242 through which a tool can pass to engage the tool slot 110 of the screw head 111 to adjust the adjustment valve 104. An engagement area 243 of the cap 240 is located at an end opposite the base end 241 of the cap 240. The engagement area 243 comprises an axial locking latch 244 on the exterior of the cap 240 and a radial locking area 245 within the insertion hole 242 of the cap 240.

The axial locking latch 244 is semi-circular and extends radially around the cap 240 forming a shoulder approximately 256° around the exterior of the cap 240. The latch 244, while the cap 240 is retained in a disengaged position, is received in reliefs 236 and 237 in the retention holes 233 and 230 of the retainer 221. The reliefs 236 and 237 which prevent spreading of the retainer 221 while the cap 240 is retained in a disengaged position, are configured to align the caps 240 in a rich stop position. A detachment prevention lip 246, which extends radially about the end of the cap 240 opposite the base end 241, prevents the cap 240 from being detached from the retainer 221 while in the disengaged position by abutting inner surfaces 232*a* and 229*a* formed nearly adjacent the retention holes 230 and 233 by the cylindrical cutouts 229 and 232 in the retainer 221. After being pushed forward into the retainer 221 to engage the valve 104, the latch 244 abuts inner surfaces 232*a* and 229*a* of the retainer 221 axially locking the cap 240 on the valve 104. A ramped forward portion 244*a* of the latch 244 enables the cap 240 to be easily moved under a relatively low pushing force to an engaged position from a disengaged position within the retainer 221. The force necessary to shear off the latch 244 will also damage the retainer 221, thus, revealing that the cap 240 and retainer 221 had been tampered with.

The radial locking area 245 comprises a smooth bore with a diameter that is larger than the diameter of the screw head 111 but smaller than the diameter of the knurled head 108 of the valve extension 107. This configuration enhances the cap's 240 capability of low force installation since the screw head 111 does not come in contact with the radial locking area 245 of the cap 240. The course knurls 108*a* of the knurled head 108 allow the plastic of the radial locking area 245 room to displace and create a large rib of plastic between the knurls 108*a* which better resists torque.

Therefore, with the carburetor fuel adjusting device of the present invention, the user can adjust the air-fuel mixture while limiting the risk of problems such as power decrease, worsening of the exhaust gas quality, or engine stoppage resulting from an overly lean or overly rich mixture. In addition, the device tends to diminish the possibility of deliberate, resolute and undetected tampering, and tends to diminish possible engine damage or improper adjustment valve adjustment during its installation.

While the above description contains many specificities, these should not be construed as limitations on the scope of the invention, but rather as an exemplification of preferred embodiments thereof. Other variations are possible.

Accordingly, the scope of the present invention should be determined not by the embodiments illustrated above, but by the appended claims and their legal equivalents.

What is claimed is:

1. A limit device for a carburetor comprising a body, a fuel adjustment valve inserted in said body, said adjustment valve including a valve extension extending from said body, said valve extension having a screw head formed on the end thereof, a knurled portion nearly adjacent said screw head, and a lock groove interposed between said screw head and said knurled portion, and a generally cylindrical cap mounted on said adjustment valve, said cap including an axial latch adapted to foldably pass over said screw head and close into said lock groove of said valve extension, and a radial lock adapted to engage said knurled portion of said valve extension.

2. The limit device of claim 1, wherein said axial latch comprises thin plastic extending angularly and inwardly away from said body.

3. The limit device of claim 1, wherein said cap further comprises at least one radially extending appendage adapted to limit rotation of said cap.

4. The limit device of claim 1, wherein said cap is received in a retainer.

5. The limit device of claim 1, wherein said knurled portion of said valve extension comprises a plurality of coarsely and longitudinally cut knurls.

6. The limit device of claim 1, wherein said radial lock of said cap further comprises radial lock grooves longitudinally cut internal to said cap.

7. The limit device of claim 1, wherein said screw head is constructed to break away from said valve extension of said adjustment valve at a torque approximately exceeding 8 kg-cm.

8. The limit device of claim 1, wherein said axial latch has a plurality of slits cut therein.

9. A limit device for a carburetor comprising a body, a fuel adjustment valve retained in said body and having a valve extension extending away from said body, said valve extension including a screw head formed on the end of said valve extension and a lock groove radially cut into the valve extension nearly adjacent the screw head, said screw head being constructed to break away from said valve extension at about 8 kg-cm torque, and a cylindrical cap having an axial latch and a radial lock adapted to engage said valve extension of said adjustment valve.

10. The limit device of claim 9, wherein said cap further comprises at least one radially extending appendage adapted to limit rotation of said cap.

11. The limit device of claim 9, wherein said cap is received in a retainer.

12. The limit device of claim 9, wherein said valve extension further comprises a knurled portion nearly adjacent said lock groove, said knurled portion comprising a plurality of coarsely cut longitudinal knurls.

13. The limit device of claim 9, wherein said radial lock of said cap further comprises radial lock grooves longitudinally cut internal to said cap.

14. The limit device of claim 9, wherein said axial latch internally extends angularly away from said body in said cap, said axial latch being adapted to foldably pass over said screw head and close into said lock groove of said valve extension of said fuel adjustment valve.

15. A limit device for a carburetor comprising a body, a fuel adjustment valve inserted into said body, said adjustment valve including a valve extension extending away from said body and having a knurled portion, a retainer attached to said body and adapted to receive said valve extension, and a cap received in said retainer, said cap having an axial lock and a radial lock, said axial lock being external to said cap and adapted to abut a stop in said retainer, said radial lock being adapted to engage said knurled portion of said valve extension.

16. The limit device of claim 15, wherein said cap further comprises at least one radially extending appendage adapted to limit rotation of said cap.

17. The limit device of claim 15, wherein said knurled portion of said valve extension comprises a plurality of coarsely cut longitudinal knurls.

18. The limit device of claim 17, wherein said radial lock of said cap further comprises radial lock grooves longitudinally cut internal to said cap.

19. The limit device of claim 15, wherein said screw head is constructed to break away from said valve extension of said adjustment valve at about 8 kg-cm torque.

20. A limit device for a carburetor comprising a body, a fuel adjustment valve inserted in said body, said adjustment valve including a screw head formed on an end external to said body, and a cap mounted on said adjustment valve, said cap including a latch adapted to foldably pass over said screw head and axially lock said cap on said adjustment valve.

21. The limit device of claim 20 wherein said cap further comprises a radial lock adapted to engage said screw head.

22. The limit device of claim 20, wherein said axial latch comprises thin plastic extending angularly and inwardly away from said body.

23. The limit device of claim 20, wherein said cap further comprises at least one radially extending appendage adapted to limit rotation of said cap.

24. The limit device of claim 20, wherein said cap is received in a retainer.

25. The limit device of claim 21, wherein said radial lock of said cap further comprises radial lock grooves longitudinally cut therein.

26. The limit device of claim 20, wherein said screw head is constructed to break away from said valve extension of said adjustment valve at a torque approximately exceeding 8 kg-cm.

27. A limit cap for a carburetor fuel valve comprising a generally cylindrical body, and a latch formed internal to said body, said latch being adapted to foldably pass over a screw head of a carburetor fuel valve and axially lock said body on the fuel valve.

28. The limit cap of claim 27 further comprising a radial lock formed internal to said body.

29. The limit cap of claim 27 wherein said latch is formed of thin plastic.

30. The limit cap of claim 27 further comprising a radially extending appendage.

31. The limit cap of claim 28, wherein said radial lock further comprises grooves longitudinally cut therein.

* * * * *

UNITED STATES PATENT AND TRADEMARK OFFICE

CERTIFICATE OF CORRECTION

PATENT NO. : 5,630,965

DATED : May 20, 1997

INVENTOR(S) : Scott R. SHAW et al.

It is certified that error appears in the above-indentified patent and that said Letters Patent is hereby corrected as shown below:

Column 2, line 36, before "adjustment" insert --on the--.

Column 3, line 15, change "course" to --coarse--.

Column 8, line 13, change "course" to --coarse--.

Column 4, line 12, after "rotated" insert --90°--.

Signed and Sealed this

Eighteenth Day of November 1997

*Attest:*

*Attesting Officer*

BRUCE LEHMAN

*Commissioner of Patents and Trademarks*